US008230870B2

(12) United States Patent
Horejsh

(10) Patent No.: US 8,230,870 B2
(45) Date of Patent: Jul. 31, 2012

(54) SUV TENT TRAVELER

(75) Inventor: Robert Douglas Horejsh, Altoona, WI (US)

(73) Assignee: Robert D. Horejsh, Altoona, WI (US)

( * ) Notice: Subject to any disclaimer, the term of this patent is extended or adjusted under 35 U.S.C. 154(b) by 0 days.

(21) Appl. No.: 13/185,877

(22) Filed: Jul. 19, 2011

(65) Prior Publication Data

US 2012/0132241 A1 May 31, 2012

(51) Int. Cl.
*E04H 15/06* (2006.01)

(52) U.S. Cl. ..... 135/88.13; 135/88.09

(58) Field of Classification Search ..... 135/88.09, 135/88.13, 88.16; 296/26.11, 156, 161
See application file for complete search history.

(56) References Cited

U.S. PATENT DOCUMENTS 3,410,598 A * 11/1968 Davis et al. ..... 296/176
3,463,540 A * 8/1969 Carr ..... 296/161
3,763,607 A * 10/1973 Glover ..... 52/68
4,109,954 A * 8/1978 Wall ..... 296/161
4,504,049 A * 3/1985 Straub ..... 135/88.16
4,729,594 A * 3/1988 Hoff ..... 296/161
5,066,065 A * 11/1991 Baughman ..... 296/165
5,226,689 A * 7/1993 Roe et al. ..... 296/159
5,491,933 A * 2/1996 Miller et al. ..... 52/67
5,738,130 A * 4/1998 Thomas ..... 135/88.13
5,820,190 A * 10/1998 Benner ..... 296/26.09
5,921,614 A * 7/1999 Biedermann et al. ..... 296/159
5,934,726 A * 8/1999 Bossett ..... 296/26.11
6,286,883 B1 * 9/2001 Schneider et al. ..... 296/26.14
6,312,034 B1 * 11/2001 Coleman et al. ..... 296/26.1
6,871,896 B1 * 3/2005 Owen ..... 296/26.11
6,929,302 B1 * 8/2005 Demick et al. ..... 296/26.01
7,240,684 B2 * 7/2007 Yang ..... 135/88.07

* cited by examiner

*Primary Examiner* — Noah Hawk

(57) ABSTRACT

An elevated floor camper tent for SUV (Sport Utility Vehicle) type vehicles having electric, hybrid or other energy-saving, lower horsepower engines and top hinged rear doors. The entire tent assembly fits inside the vehicle for aerodynamic maximization and the state-of-the-art materials minimize the total weight. A set of continuous slides provides support and, with integrated footpads, facilitates setup on hard or soft surfaces. The campers sleep within the relative safety of the vehicle and utilize the main part of the tent as a living area. The standard features, under actual test conditions, suggest the design as safe, effective and user-friendly plus the stable, framed living area having built in rail-type support braces and kick panels help prevent the users from accidents.

2 Claims, 9 Drawing Sheets

SUV TENT TRAVELER

CROSS-REFERENCING TO RELATED APPLICATIONS

A review of prior art disclosed a number of patents with a collapsible camper-tent apparatus' although they were primarily designed for vans, pick-ups and hatchback-type vehicles without addressing the needs of lower-power, higher-mileage SUV type vehicles of the present and the future. The higher-mileage, hybrid and electric vehicles could be utilized for camping thus enhancing their versatility and general usage in the camping community. Our camper-tent invention is designed from the ground up to be specifically used by the vehicles of now and in the future. The prior art teaches aspects of tent-campers with dated features common to the genre but without the totality needed for modern lower-powered, hybrid, electric and other mileage enhanced vehicles like our invention. U.S. Pat. No. 5,921,614 Biedermann Jul. 13, 1999 is cumbersome and on two levels rather than a continuous flat plane, thus limiting each area for usage. The apparatus slides on a single-stage slide without regard to the necessary overlapping to give strength so the proportion is misleading. The diminished square footage of each level reduces versatility and it would not be long enough for an average person's height if shown in true relative proportion. The "platform panel" "having a plurality of horizontal guide tubes, intersecting in a perpendicular manner through a plurality of vertical support members" is in reality not suitable for sleeping on either level and said platform panel appears heavy in design. Our design utilizing a continuous flat plane slide affords planar space for extra-long sleeping mats of standard width plus a separate tented area or relaxing free from bugs in elevated floor panel with room for the cargo. Our design allows for complete setup before moving the cargo whereas the Biedermann apparatus' storage space is under their platform panel, either limiting the space between the platform and the ceiling of the vehicle and/or limiting the "large, organized way to store belongings out of sight with easy access." Our design maximizes the space between the floor panel and the ceiling of the vehicle, creating not just more square footage but considerably more cubic footage of elevated area on one geometric plane. The Bidermann design depends on the rear-hinged door to support the extended tent area whereas our design has an integrated framework for support as said door does not usually lock in the open position and additionally limits the space below it to the length of said door. The Biedermann design shows three support legs terminating at ground level with only the area of the end supporting the extended apparatus rather than the flat side of the channel foot-pads supporting our design. U.S. Pat. No. 4,504,049 Straub Mar. 12, 1985 features a hinged-system instead of a continuous flat plane slide, thus limiting the length of the extension to the swing space between the apparatus and the top of the rear door opening. The minute detail of the methods for securing the "membrane" to the vehicle is similar to our invention although the overall concept is very different. Those are mostly standard methods employed by any marriage of dissimilar materials in attaching a tent to a vehicle. U.S. Pat. No. 4,729,594 Hoff Mar. 8, 1988 is for a van-type vehicle with side opening doors and more inherent space than afforded by a modern SUV, particularly the smaller vehicles of today and in the future. It does feature a slide arrangement but on two levels rather than one continuous flat plane making each level less versatile although fairly integrated for ease of setup. Our invention is completely integrated with the different components designed for space-restricted vehicles and is completely off the ground. The Hoff design would not work in the same restrictive environments as our invention and weight might be inherently prohibited. U.S. Pat. No. 4,109,954 Wall Aug. 29, 1978 is "for use with a pick-up truck" rather than a modern SUV and "the floor member is essentially removed from the pick-up bed" rather than mounted on continuous flat plane slides like our invention. The support legs and tent are not integrated into the floor member for ease of setup and is inherently inconsistent on the placement location of the support members unlike our invention wherein the entire superstructure, except the peak, is pre-connected and inherently more consistent in setup. The other references cited include designs that pivot or are hinged rather than our continuous flat plane slide including Davis, Baughman, Roe, Bossett or are for vans or pickup trucks. Also, our invention is not a ground tent like Thomas teaches so, overall our invention is unique in design and in what it teaches compared to the teaching of the aforementioned patents.

The "SUV Tent Traveler" (name used for identification purposes only) is a concept of a tent, tent frame, elevated camper floor contained entirely within the vehicles' storage area and mounted on continuous slides. The vehicles' original aerodynamic design is not disturbed and the total weight of the unit is well under 150 lbs. The footprint is small and the unit can be setup on most surfaces, whether soft like sand or hard like concrete. The campers sleep in the extended storage area with hard sides all around them during inclement weather and the rest of the unit is high enough to stand up in or sit with table and chairs in an insect-free environment. Security is another factor as the compacted unit is inside the vehicle and, when setup, cannot be wheeled off if the camper chooses to use the vehicle separately, leaving the set up camper/tent on site.

Earth-friendly vehicles are limited for camping although we purchased a Ford Escape Hybrid knowing the towing capacity was only 1,000 lbs. (passengers and cargo included). What we didn't know was that already optimistic rating was based on a flat surface at lower altitudes and campers under 1,000 lbs. were barely available, those being very expensive. Alternatives involved roof top units with a MPG robbing aerodynamic drag; mini trailers with the inherent problems of pulling another object; and tents, set directly on the ground with a boot to connect to a vehicle. We found the vehicle rear area too short to comfortably sleep in so, in effect, that alternative (attached ground tent) was really just camping out. Earth-friendly vehicles include hybrid, electric, enhanced, dual or multiple mode-powered vehicles, or generally any vehicle with lower rated horsepower for higher MPG, designed by the manufacture to save energy through aerodynamic design with top hinged rear doors.

BRIEF SUMMARY OF THE INVENTION

We designed and built different prototypes to minimize the compacted apparatus dimensional size and weight until we refined the resultant invention as depicted herein. The compacted unit in the rear cargo area of a modern Sports Utility Vehicle, or SUV, although the design could work on any top hinged rear door vehicle with sufficient cargo space when the rear passenger seats are folded down, presenting a flat surface. When said apparatus is fully extended, there is room for two standard sleeping mats' widths and long enough for the extra-long length sleeping mats. The key to its uniqueness is a continuous flat plane slide system comprised of a plurality of sections adjacent to each other to extend the main floor panel longitudinally out from under the cargo floor panel. Adjustable legs are deployed via hinged extension panel, if utilized, to support the apparatus to its full-extended position before installing the transition floor panel, between the cargo floor panel and adjacent to the main floor panel, resting on the continuous flat plane slides. The cargo floor panel is then lowered to the top of the said slides by folding two or four legs, thus providing a completely single surface planar height throughout the entire setup apparatus. Another key to the invention's uniqueness is the use of integrated component design wherein most are pre-attached or by various means pre-connected to facilitate setup ease and component integrity. The integrated adjustable legs' features a larger surface area in contact with the ground by implementing flat channel foot-pads.

In the near future, more hybrid vehicles on the roads and more miles per gallon have been requested by the Federal Government, earlier projections suggesting potentially one million plug-in hybrid and electric cars by 2015 and mileage standards of 54.5 mpg by 2025. This concept/invention could help facilitate that goal by making the present and future vehicles more versatile and camping-friendly like it did for us. greed, and our particular invention could enhance hybrid usage, which was under, until now, inadequate performance capabilities for most camper/trailer utilization. We built and tested a prototype under actual inclement camping conditions with favorable results in heavy rain and windy conditions so if this patent is accepted, production for other hybrid owners could very well enhance popularity of hybrids for more potential users.

BRIEF DESCRIPTION OF THE SEVERAL VIEWS OF THE DRAWINGS

The drawings are each fairly proportionate although the different scales as depicted are accurate to the particular scale on each of the other drawings.

DETAILED DESCRIPTION OF THE INVENTION

The "SUV Tent Traveler" is a concept of the tent, camper floor and frame contained entirely within the vehicles' (an energy-effective SUV-type vehicle) storage area. The vehicles' original aerodynamics, designed to reduce air resistance, are not negatively impacted by the addition of a towed or rooftop contrivance. Additionally, the minimized weight of the unit assures adaptability to any hatchback or top-hinged rear access door. The weight displacement provides a lower center of gravity while stored and driving. The inspiration for the concept was the inability of hybrid vehicles to tow conventional campers and the low cargo weight capacity. The concept may prove to fill a niche of non-hybrid vehicles with similar design, particularly for those users not needing the usual rear passenger seats for traveling. Besides saving energy, the footprint is small and can be setup on softer or harder surfaces then a conventional ground type tent as stakes are not needed. Safety features include sleeping in the original storage area with four hard sides surrounding the camper (floor, sides and ceiling) and the rest of the area being elevated well above the ground. Other designed safety features include an enhanced-width base for stability, locking legs in vertical position, an interior kick-panel on deck floor and a bar/railing in the tent area where the camper persons can stand.

Figure 1:
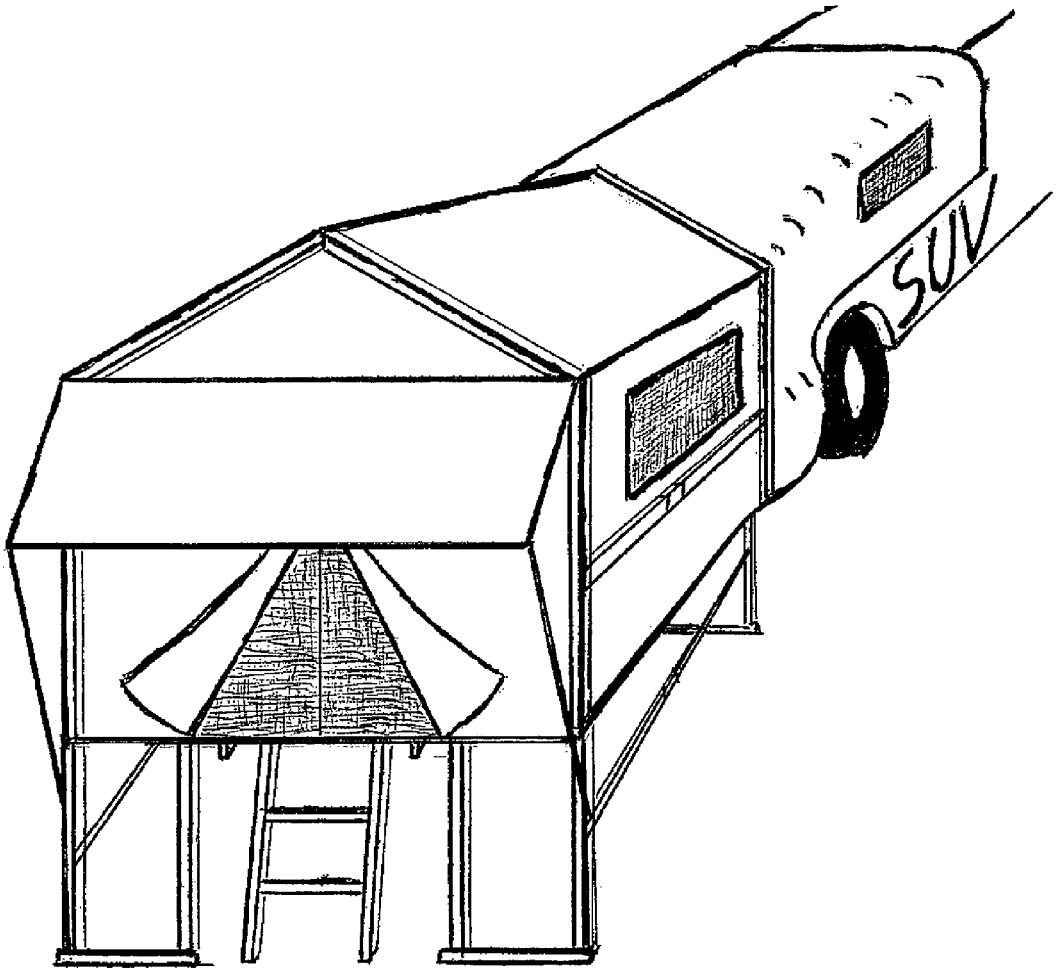
FIG. 1 is a rear view of the apparatus fully deployed on the continuous flat plane slides showing the channel foot-pads, tent and mesh material, the leg support braces, the safety railing brace with the tent supports on the outside of the tent material.
Figure 2:
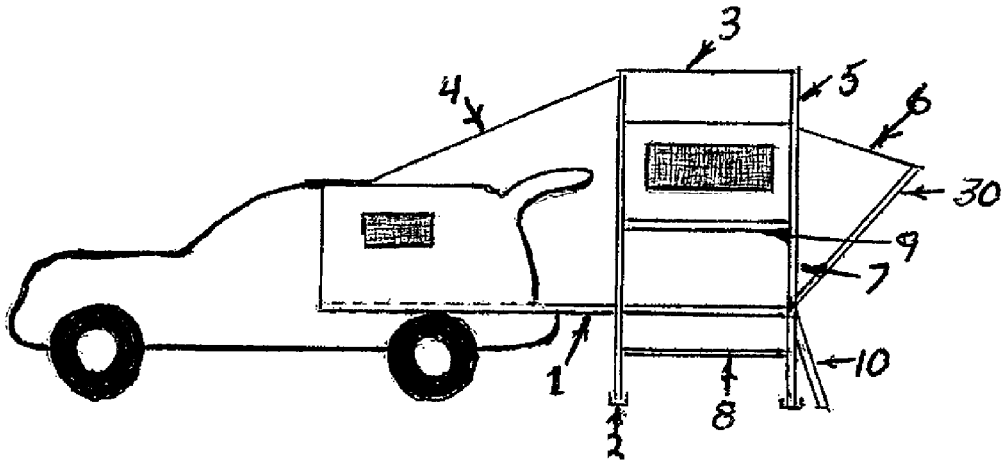
FIG. 2 is a side view of the apparatus fully extended and the continuous flat plane slides or coplanar.

The fully setup apparatus, or camper-tent, is shown in FIG. 1, with the vehicle in the background. The ends of the continuous flat plane slides are visible as attached to the bottom of the main floor panel, with the extending floor panels deployed. The tent material pre-attached to the peak of the tent material to the peak support. The superstructure as shown in FIG. 1 and FIG. 2, or everything above the floor level of the vehicle's cargo floor area, is connected to other floor panels through various bolts and locking nuts. An inside the tent safety kick-edging, or aluminum angle, prevents chairs from sliding off the floor panels plus attaches the tent material to said floor panels. Another safety feature is a safety railing brace to prevent people from falling out of the superstructure area. The substructure includes anything below the vehicle's floor level, is similarly connected for safety and ease of setup.

In FIG. 2, The continuous flat plane slide 1 is shown joining the apparatus to the vehicle, the tent support 7 and peak support 5 support the tent material 3, 4 connecting the camper-tent apparatus to the front upper part of the vehicle is via either suction cups and/or magnetic strips, both commercial and used extensively on similar applications. The rear door canopy 6 is also commonplace although in the spirit of minimizing loose components and parts on our invention, the canopy support 30 compacts alongside the tent support 7 and is attached to the same bolt for connection to the tent support 7. The safety railing 9 and the leg support brace 8 are folded as apparatus is compacted. The channel foot-pads 2 and step-ladder 10 come in contact with the ground.

Figure 3:
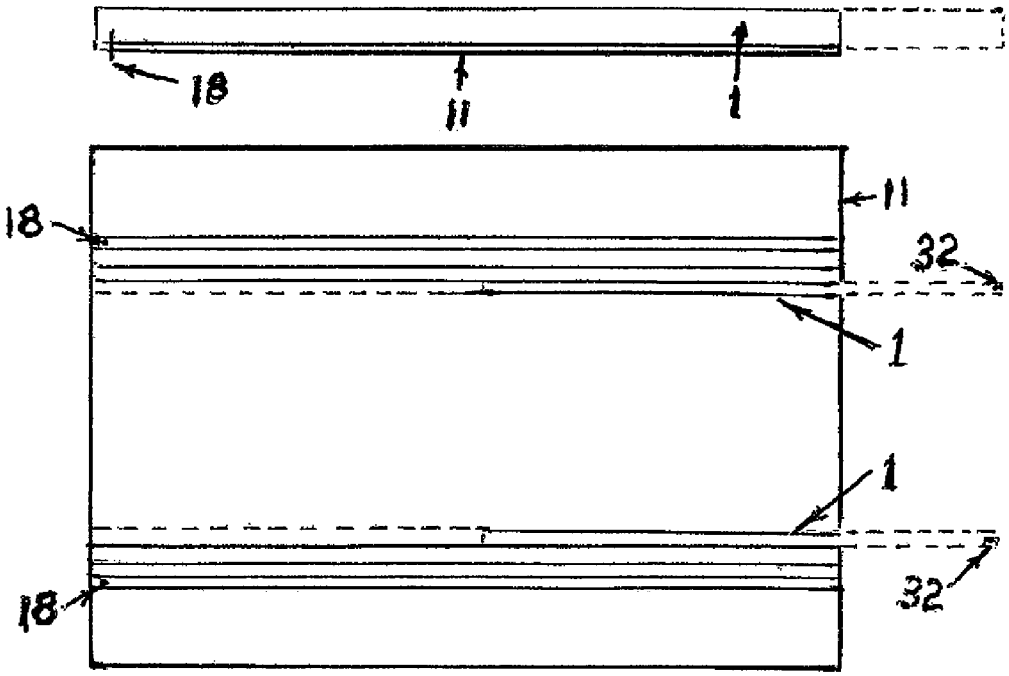
FIG. 3 is a top view of the adapting pad with the pair of continuous flat plane slides attached to the leading edge.

The step-ladder 10 folds down from its stored position when compacted and locks in place as to assist supporting the main floor panel in the partially extended position before the substructure is pulled out to its full extension. This includes the adjustable legs attached to the underside of the extending floor panels, which adjust via inserted tubing snap buttons in the smaller inside telescoping tubing and protrude from said tubing to fit in spaced holes in the larger outside telescoping tubing as in FIG. 5. The front and rear legs of the main and extended floor panel(s) area are connected by leg support brace 8, all collapsible into the other integral components to maintain the integrated concept to facilitate setup ease and component integrity. FIG. 3 shows the continuous flat plane slides 1 attached to the adapting floor panel 11 bolts 18 and a projected view of how the each slide section pulls out to a fifty percent midway point on each section for overlap strength. The leading rearward slide section fixed bolt/hole 32 connects the furthest rearward point of the continuous flat plane below the main floor panel. All four sections pull out to an accumulated length for the entire erected apparatus. All of the connections and attached components, comprising the superstructure and the substructure as aforementioned, are designed to be inherently easy to erect by fixed location of components bolted, sliding, pivoting, hinged or snap button connections.

Figure 5:
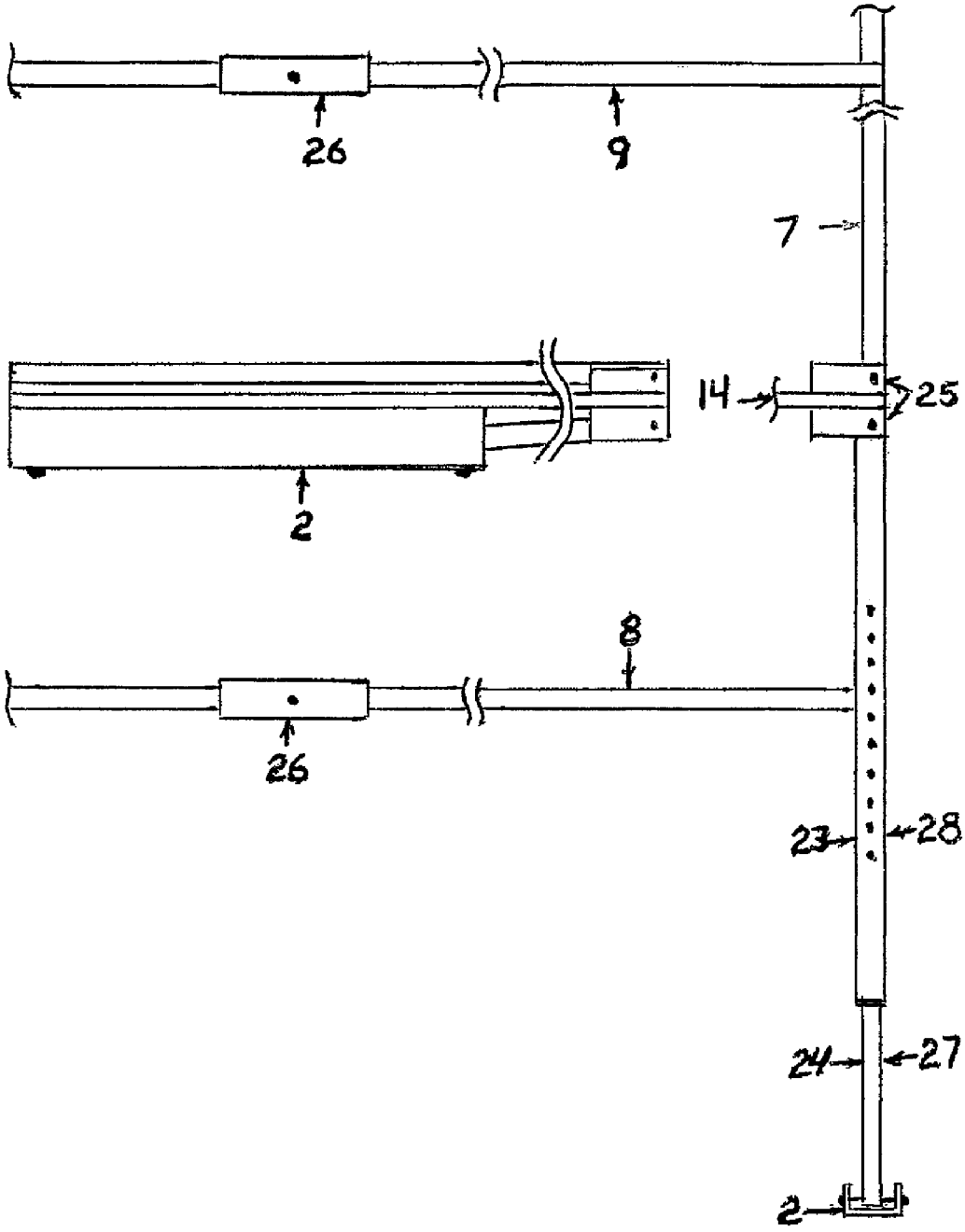
FIG. 5 is a view of an erected tent support and channel foot-pad, the safety railing brace and the leg support braces attached to the adjustable leg.

In FIG. 2 the channel foot-pads are designed to conform to various pitches of rough terrain as also shown in FIG. 5 and are adjustable in height via the legs 23, 24 by inserting a pin in the spaced holes in the larger outside dimensioned leg 23 through the best suited height adjustment hole in the smaller component of the leg 24 thus enabling a solid contact with the ground on which the erected unit rests. Legs 23, 24 are connected to the main floor panel 14 via a hinge 25 and the channel foot-pads 2, which also acts as a hinge enabling the legs and channel foot pads to fold laterally for a single perpendicular leg that is folded on hinges 25 to be parallel with the cargo floor. The safety railing braces 9, and the leg support braces 8 are secured in their horizontal positions by the connecting sleeve 26, wherein a pin is inserted through the respective braces on both sides of the apparatus and through the sleeve 26.

Figure 4:
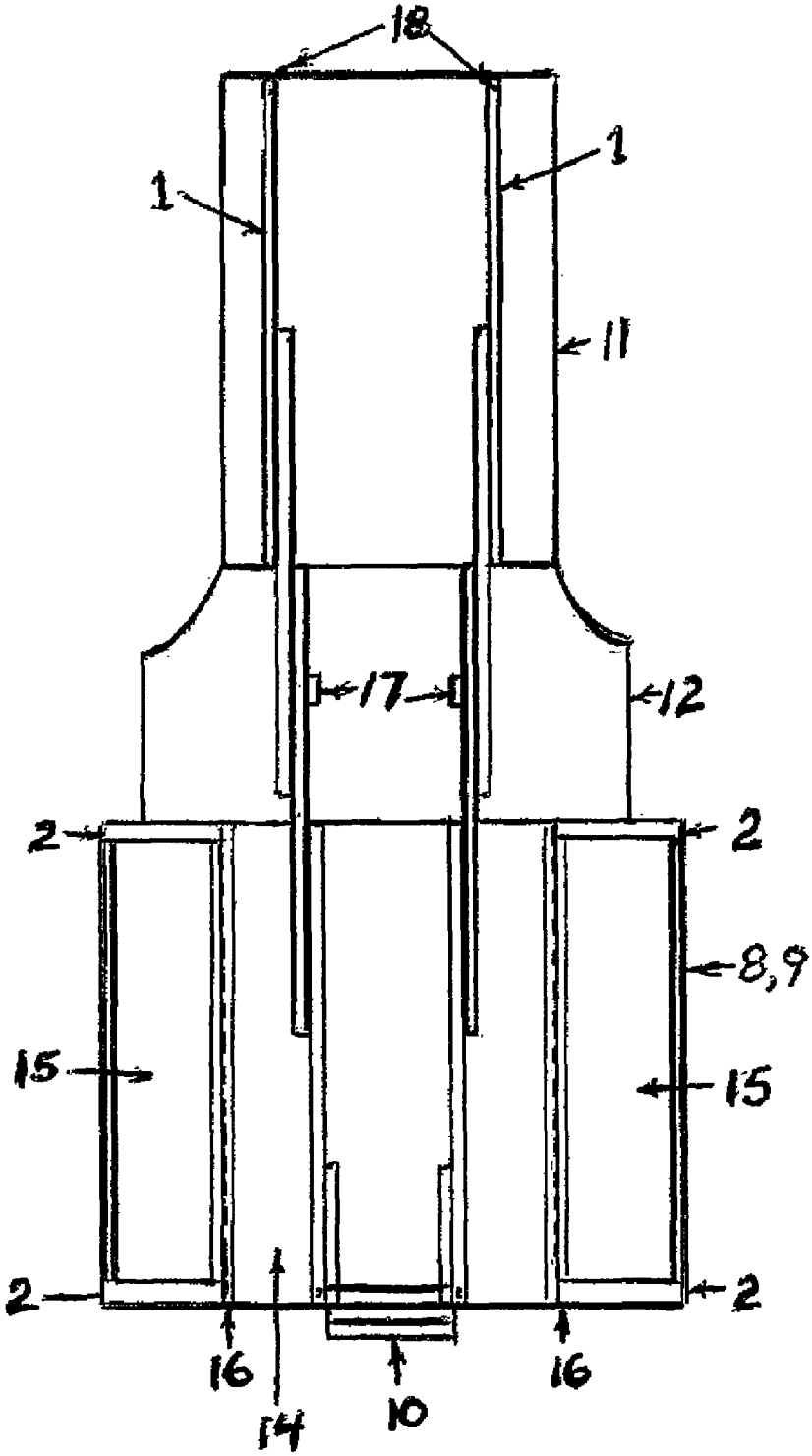
FIG. 4 is a bottom view of the cargo floor panel, the transition floor panel, if utilized, and the main floor panel and extending floor panels, if utilized, the continuous flat plane slides attached to the rear of the main floor panel. The adapting pad view has been reversed from the bottom of the slides to the top for this drawing only to avoid hidden lines.

FIG. 4 shows all of the continuous flat plane slide 1 sections fully extended and their relationship with the adapting floor panel 11, connection 18, shown in a reverse position above the slides rather than below to avoid hidden lines. The transition floor panel 12 width is shaped to configure to the width of the vehicle's door opening and the length is the length of the compacted length of the apparatus. The short lengths of aluminum angle are clips 17 to keep the transition floor panel 12 in place. The extending floor panels 15 are hinged 16 to the main floor panel 14 using a double-wrap-around hinge style for strength. The extended ends of the continuous flat plane slides 1 are attached to the main floor panel 14 with bolts 30, FIG. 3, and the step-ladder 10 nests between the pair of slide assemblies when compacted. The four each channel foot pads 2 are on either end of the two extending floor panels. The leg support braces 8, and the safety railing brace 9 are in line from this perspective.

Figure 7:
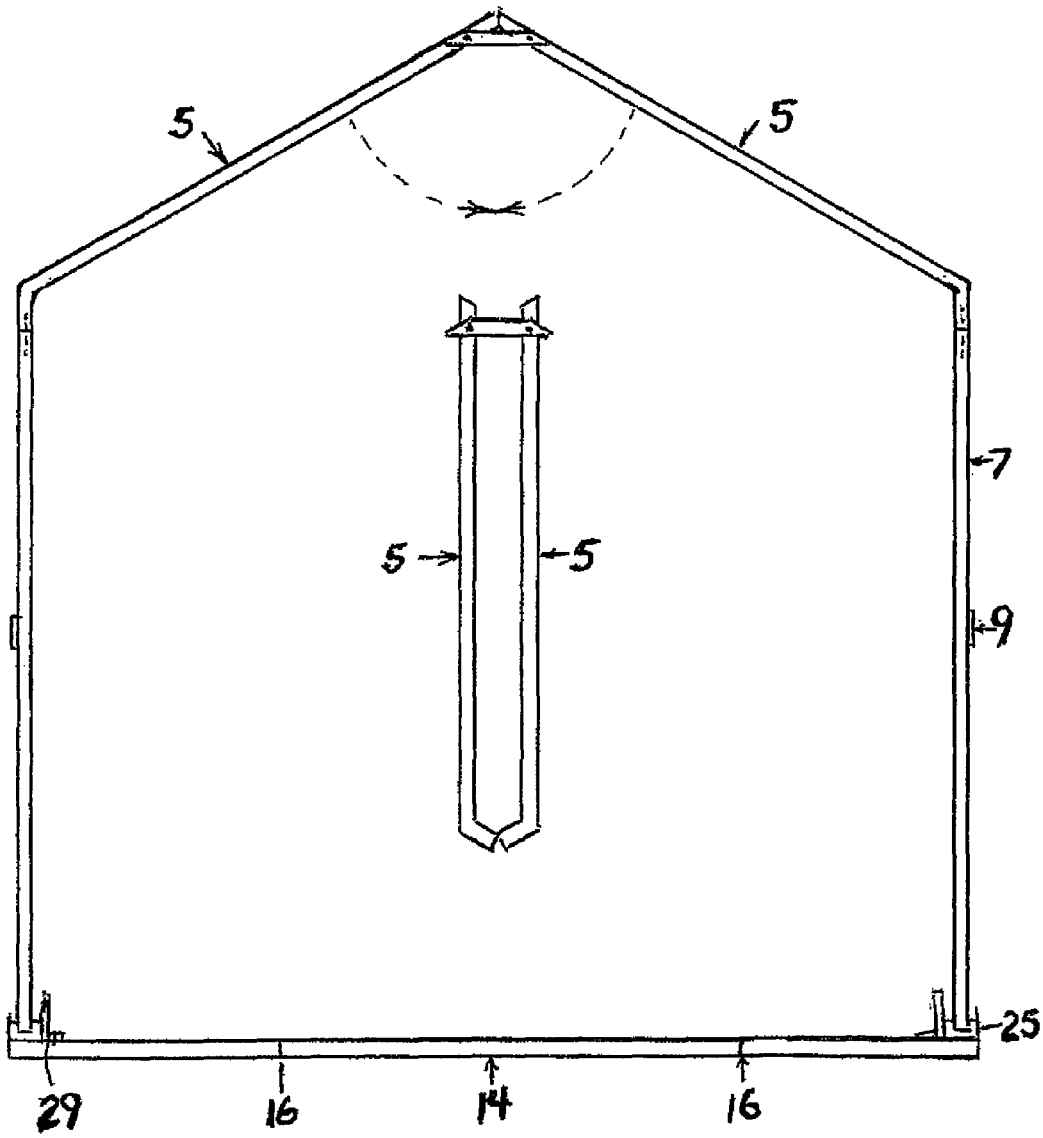
FIG. 7 is an end view of the erected tent support and shows the peak support folded for storage under the cargo floor panel.
Figure 8:
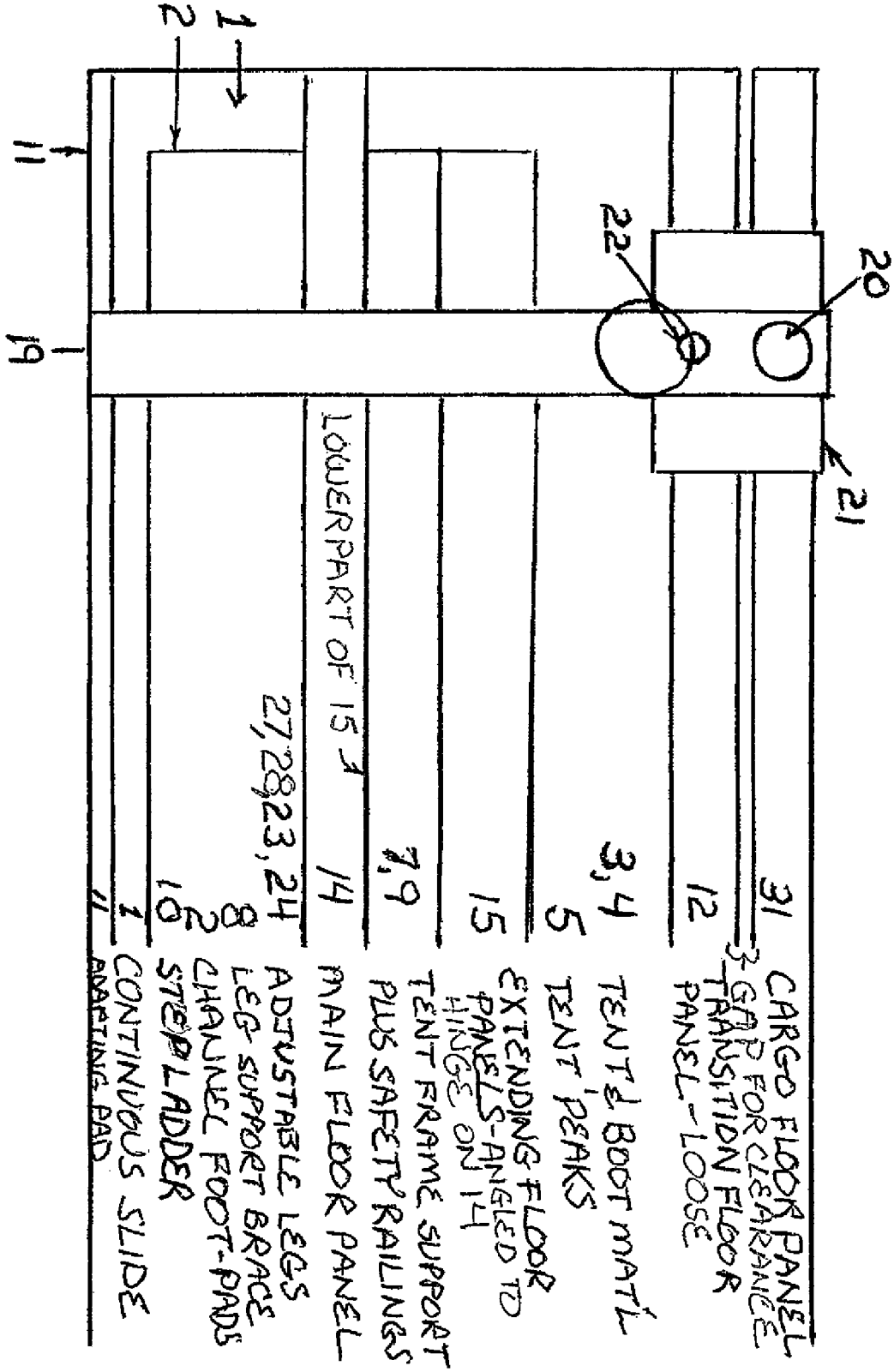
FIG. 8 is a stratum view of the compacted components at left, front corner, from the bottom strata or the adapting pad floor panel, resting on the vehicle floor, to the top strata or cargo floor panel.
Figure 10:
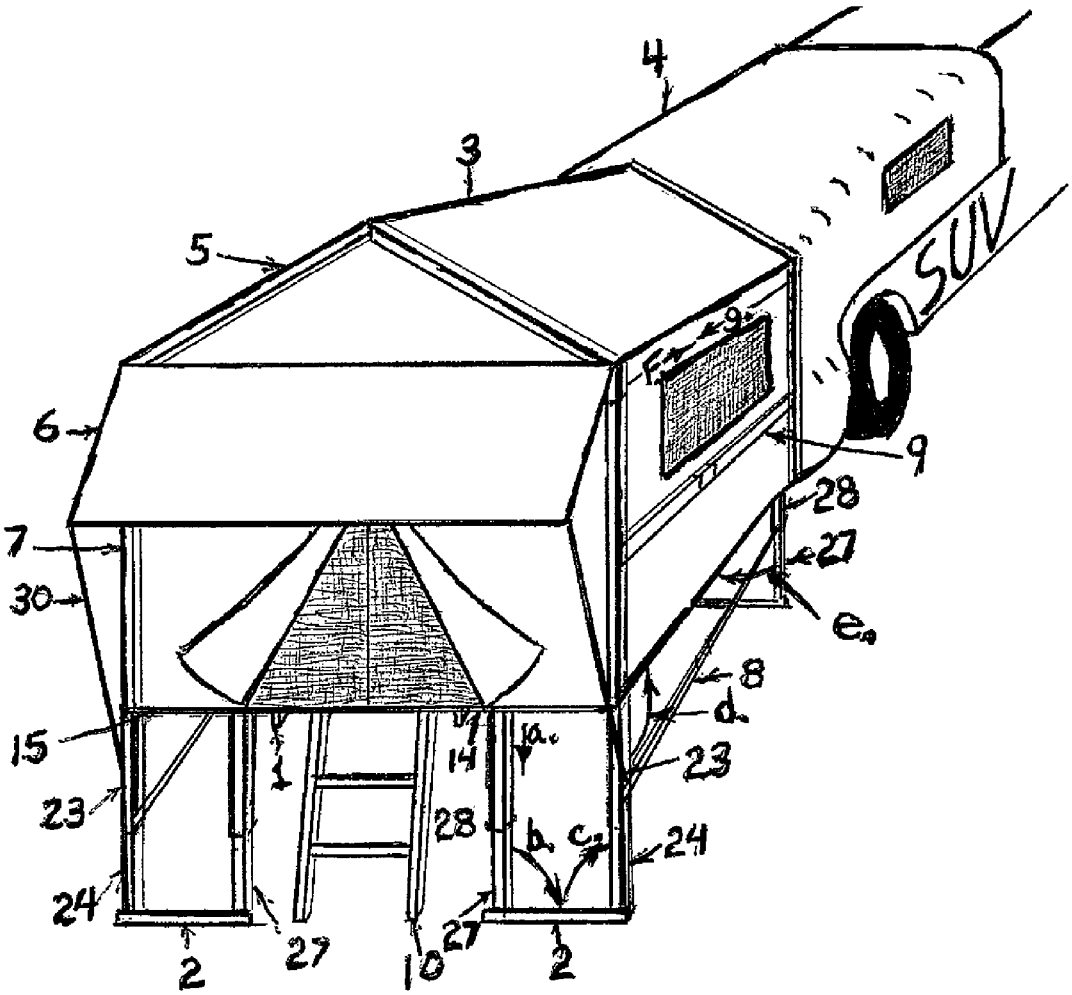
FIG. 10 is a version of FIG. 1 with numbering added for clarification.

In FIG. 10, the legs nearest the vehicle and the legs nearest the rear, or where the step-ladder 10 is all the legs fold into themselves laterally before compacting horizontally with the main floor panel 14. All of the legs ultimately fold towards the middle of the main floor panel 14 as does the components as shown in FIG. 7, folding parallel to the continuous flat plane slides. The telescoping legs 27, 28 closest to the center of the apparatus and the telescoping legs 23, 24 located on the outside of the apparatus are sized to fit together for compactness. The outside legs 23 are channel, deep enough to contain telescoping tubing legs 27, 28 when folded into the channel foot-pads 2 which are folded laterally as to be perpendicular to the main floor panel 14. The legs are nested adjacent to each other are then folded via hinges 25 to be horizontal with the main floor panel. The channel foot-pads 2 material made of wider channel than the outside leg 23 accommodate the folded legs. The inside leg 28 is attached to the main floor panel 14 via a removable pin while the outside leg 23 is on a fixed hinge to move it parallel and adjacent to the continuous flat plane slides as shown in FIG. 8. FIG. 8 is representative of the different layers or a stratum view of the various components stacked during compacting and in-vehicle stored. Multiple components are compacted adjacent to each other with a variable gap between the cargo floor panel 31 and the transition floor is laid loose upon the other components as shown. In FIG. 10 the folding sequence for the legs below the main floor panel 14 is a. where the inside leg 28 is disconnected via pin at the top nearest the main floor panel 14 and the lower section of the leg 27 telescopes into 28; then, b. where the two fold laterally into the channel foot-pad 2; which are e. folded laterally over the leg sections 23, 24 then the lower section 24 is telescoped into 23 before d. folding parallel with the main floor panel 14; then e. wherein the process is repeated to the legs assembly nearest the vehicle. This process, facilitated by all the legs having been pointed up as the hinged 16 extending floor panels 15, already been folded towards the center top of the main floor panel. The step-ladder 10 helps to support the weight of the apparatus until part of the compacted apparatus is pushed back into the vehicle via the continuous flat plane slides 1. It should be noted that the superstructure, or everything above the main cargo panel was folded-in earlier per FIG. 10 with the end nearest the vehicle g. first, then f after their respective peak supports 5 were removed from the tops of the tent supports 7.

Figure 6:
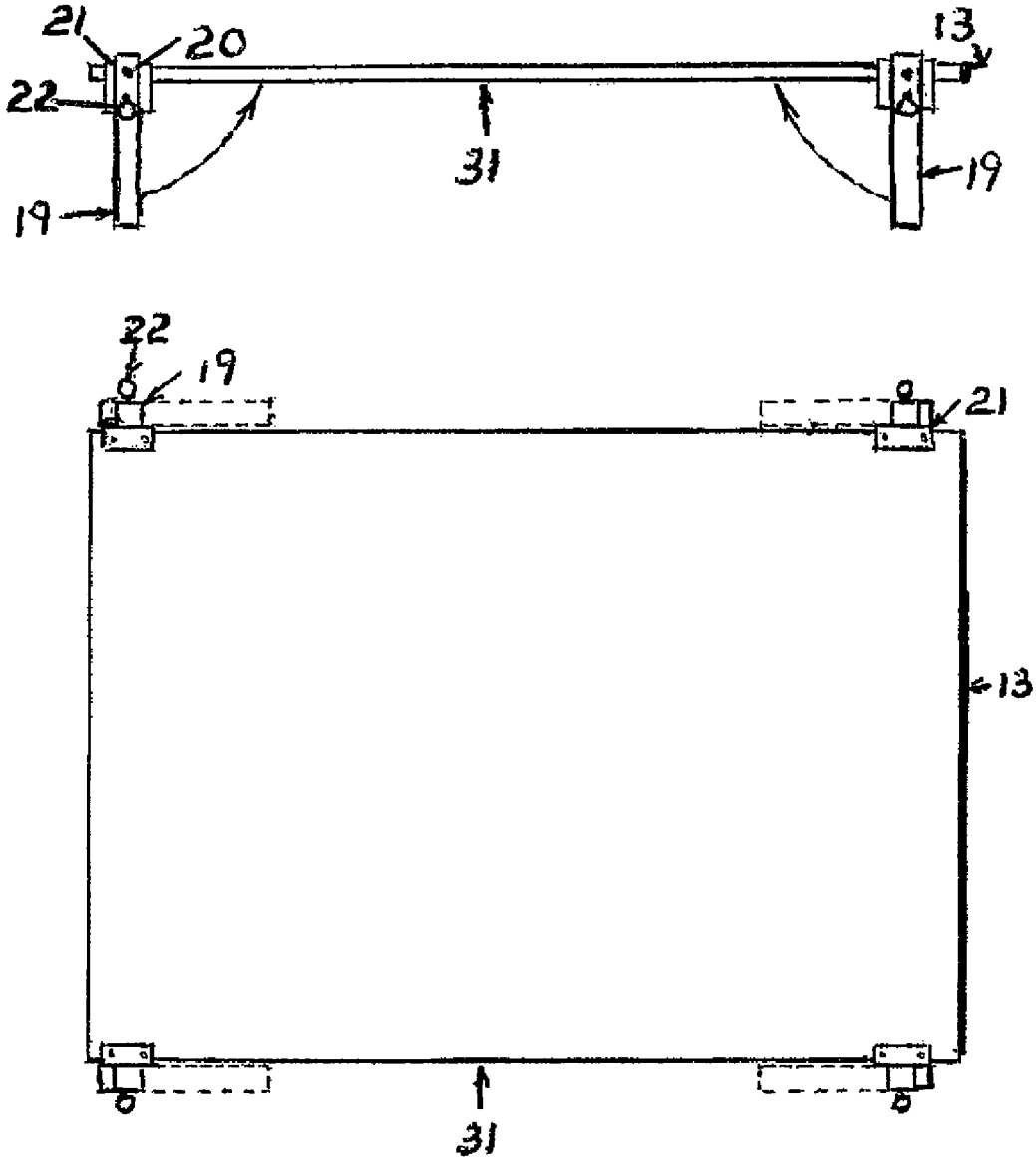
FIG. 6 is a side and top view of the cargo floor panel with foldable legs.

The cargo floor panel 31 as depicted in FIG. 6 shows the four legs, one in each corner of the assembly, their relationship with said panel plus a projection of how they fold to the center of the said panel. This is effected by pulling a spring loaded quick release pin 22 by its ring pull out far enough so the pin clears the pin stop hole in an extruded aluminum "F" shape 21 that the top of the "F" fits over said panel and secured with two screws through the extrusion and the panel. This is less stressful for the edge of said panel and a stronger connection than wood screws. Rather than lowering the entire subassembly to rest on the continuous flat plane slides, the rear legs can be folded and the front legs left in the locked perpendicular position if the sleepers preferred a raised head for comfort or to counter an affliction of acid reflux. In that scenario, the rear end of the cargo floor panel 31 rests on top of said slides, the "h" shaped aluminum extrusion 13 aiding in the smooth joint to the transition floor panel.

FIG. 7 presents an end view of the rear tent support 7 with the safety railing brace 9 in place, the aluminum kick-edging 29 which is inside the tent material 3 to attach the tent material to the extending floor panels and to the main floor panel 14. Both sides of the peak are the rare components that have to be installed manually for erection and removed for compacting. The aluminum tubing of the tent supports 7 is square as is the peak support 5 although a short section of round tubing is inserted and fixed to the end of the tent support to guide and hold the two components together. The tent material has sleeves sewn in to the peak in which the peak supports are inserted to hold the tent material in place when erected. The tent peak assembly is folded as shown in the projection while the tent material remains in place via said sleeve. This facilitates ease of assembly and disassembly necessary to keep the compacted length slightly shorter than the compacted cargo floor panel.

i.) With the pop up feature, directives e.), f.), g.), h.) are not necessary as the tent is suspended via loops to a hinged externally mounted frame and the peak assembly is also attached to the tent, requiring opening the peak assembly to its oblique configuration and connecting it to the vertical (at this point in its compacted horizontal attitude).

The stratum view of FIG. 8 is a representation of all of the compacted components and subassemblies from the cargo area floor of the vehicle, the adapting floor panel 11 is the first strata; the second strata, or layer, is the continuous flat plane slide 1; adjacent are the adjustable legs 23 24, the leg support brace 8 with the connecting sleeve 26, the channel foot-pads 2, and the step-ladder 10; the third layer is the main floor panel 14; the fourth layer up is tent support 7, safety railing brace 9 with the connecting sleeve 26, and part of the hinged extending floor panels 15; the fifth layer is the compacted tent material 3, the canopy tent material and the boot tent material 4, and the folded-in peak supports 5; the transition floor panel 12 fits on top of the and is the sixth layer up; the open space between the compacted components and the underside of the cargo floor panel 12 being supported by the cargo floor panel legs; and the top layer is the cargo floor panel 12 supporting the vehicle's rear cargo.

Figure 9:
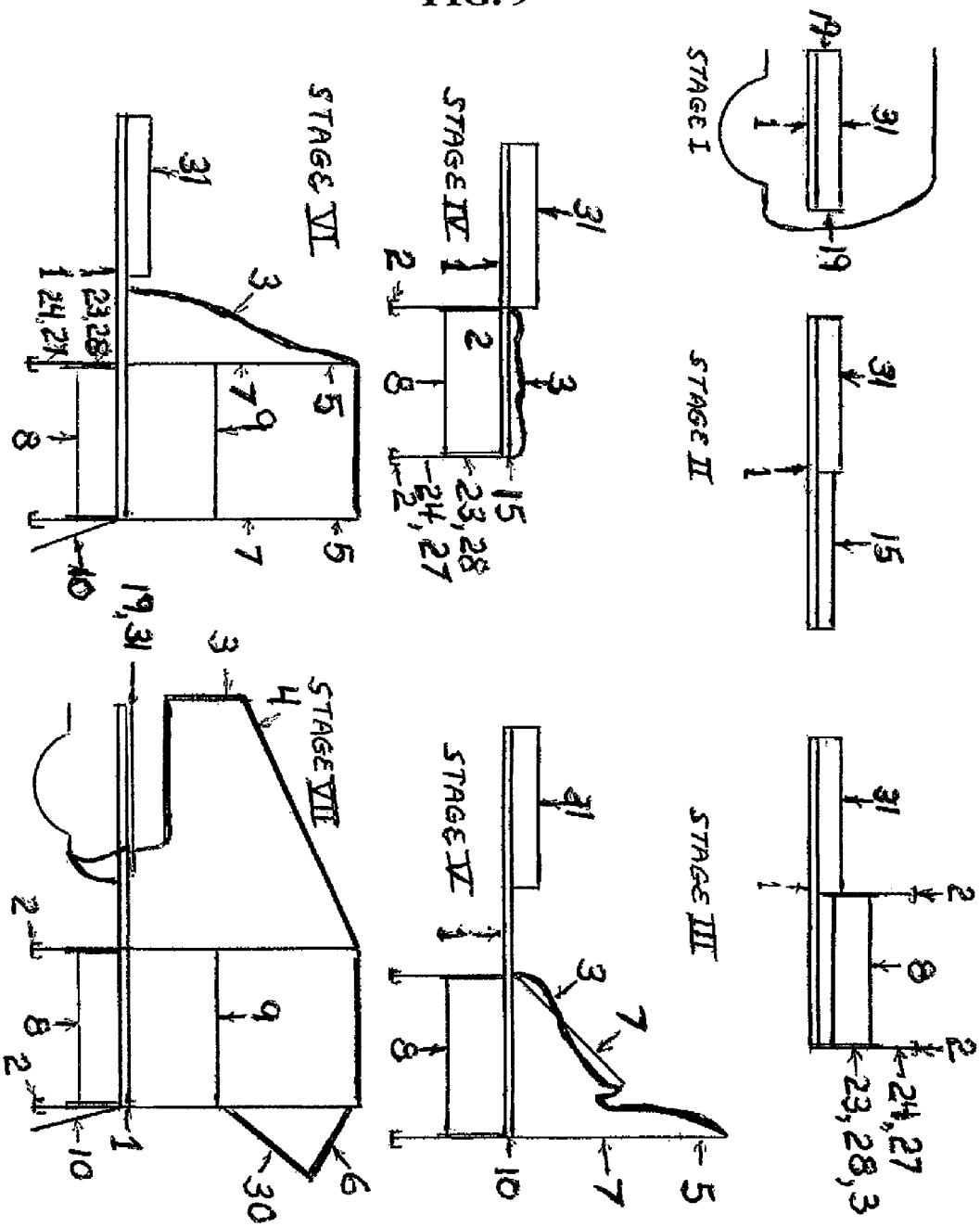
FIG. 9 is a simplified conceptual erection sequence from compacted to fully erected.

FIG. 9 is a simplified line drawing representation to teach the sequential erection of the apparatus: stage I is the compacted apparatus in its entirety inside the vehicle with the rear seat down, consisting of the cargo floor panel 31 and legs 19 perpendicular to said floor panel; stage II the main floor panel 14 with compacted components are extended via the continuous flat plane slides just far enough out from the vehicle to clear the vehicle's ceiling and rear door; stage III the legs 23, 24, 27, 28 are raised up and braced 8 on the hinged 16 extending floor panels 15 while folded; stage IV the hinged extending floor panels are opened to enable the channel foot pads 2 to rest on the ground; stage V the rearmost tent support 7 with peak support 5 raised upright with attached tent 3; stage VI the tent support 7 with peak support 5 are raised upright and the safety railing brace 9 is secured by pins; stage VII wherein the boot 4 is moved over the vehicle and attached, canopy 6 deployed on canopy supports 30, step-ladder 10 pulled out and the legs 19 are folded allowing the cargo floor panel 31 to rest on the continuous flat plane slides, thus allowing all the floor panels to be on the same plane.

The overall concept of the apparatus is one of compactness to take up as little space as possible in the vehicle's cargo area and ease of set up as most of the components are already connected through pins, bolts and hinges. The components above the main floor panel 14, including 3, 4, 5, 6, 7, 9, 12, 13, 25, 26 and 30, fold to the center and middle of the main floor panel. In FIG. 7, the components as shown fold down towards the middle of the main floor panel 14 so the frame, or tent support 7, closest to the vehicle folds in when compacting as does the identical frame closest to the rear of the apparatus or where the step-ladder is. The result is the rear-most frame lies on top of the frame, or tent support 7 closest to the vehicle when compacted or in-vehicle stored. The components below the main floor panel 14, including 1, 10 and 11, compact on a horizontal plane. The components stored on the upper side of the main floor panel 14 but swing up and down on hinged 16 extending floor panels 15 when erected so are then below the main floor panel 14 includes 2, 8, 18, 23, 24, 27 and 28 after erection.

The invention claimed is:

1. A collapsible and completely integrated design camper-tent apparatus for use with a cargo area of a top-hinged rear door vehicle, the apparatus having a compacted and erected state, the apparatus comprising:

a) an adapting pad received in the cargo area and lying on the floor thereof, b) a pair of continuous flat plane slides attached to a leading edge of the adapting pad via bolts, said slides contained in and capable of extending outwardly from the cargo area, the slides including a plurality of sections wherein each section of the slides, when extended, overlaps an adjacent section by at least one half of the length of each section, c) a cargo floor panel with four corners, each corner having a vertical leg that is foldable and extendable to move the cargo floor panel between a raised and a lowered position, d) a transition floor panel, and e) a main floor panel connected at its rear end to the slides, the main floor panel including:

extending floor panels hingedly mounted on side edges of the main floor panel, a step-ladder foldably mounted to a rear end of the main floor panel, a tent structure having tent supports hingedly connected at corners of the main floor panel and extending upward, peak supports removably attached at the top of adjacent tent supports and extending perpendicular to the continuous flat plane slides, safety railing braces removably attached between adjacent tent supports and extending parallel to the continuous flat plane slides, and a canopy tent material supported by the tent supports and peak supports to provide an enclosed shelter, telescoping legs hingedly connected at corners of the main floor panel and extending downward, the legs including a foldable channel foot pad hingedly connected at one end to a bottom of the leg, the channel foot pad including a telescopic inside leg hingedly attached at an opposite end thereof to extend upward to support the main floor panel, leg support braces removably attached to the telescoping legs and extending parallel to the continuous flat plane slides, wherein when the apparatus is in the compacted state, the cargo floor panel is in the raised position and overlays the transition floor panel, the main floor panel and the tent structure within the cargo area, and when the apparatus is in the erected state, the main floor panel is extended outward on the slides with the extending floor panels folded outward, the transition floor panel is inserted between the main floor panel and the cargo panel in its lowered position, thereby forming a single planar floor, the telescoping legs are deployed to support the main floor panel and the tent structure is erected to form the shelter.

2. The camper-tent apparatus of claim 1, wherein the cargo floor panel vertical legs are:

a) of sufficient length to hold the cargo floor panel above the main floor panel and transition floor panel and the continuous flat plane slides without contact interference with the bottom of cargo floor panel when extending to the erected state, b) pivotally connected to the cargo floor panel by a bolt through a hole in the leg enabling a free pivoting action of the leg, c) locked in the extended position by use of a quick release spring loaded pin which fits into a hole on an extrusion attached to the cargo panel, the extrusion having a clearance hole located at the same plane as the pin, d) when said pin is pulled out of the clearance hole, the legs pivots towards the center of the cargo floor panel, allowing the cargo floor panel to drop to the top surface of the continuous flat plane slides, or e) the forward legs can be left locked in the vertical position and the rear legs can be unlocked via said pin and allowed to drop to the top surface of the continuous flat plane slides, thus creating a raised head sleeping area for those people desiring such a feature.

* * * * *